US008056780B1

(12) United States Patent
Bruns

(10) Patent No.: US 8,056,780 B1
(45) Date of Patent: Nov. 15, 2011

(54) BELT BUCKLE WITH COMPARTMENT FOR PORTABLE DEVICE

(76) Inventor: Judi L. Bruns, Whittier, NC (US)

( * ) Notice: Subject to any disclaimer, the term of this patent is extended or adjusted under 35 U.S.C. 154(b) by 813 days.

(21) Appl. No.: 11/970,873

(22) Filed: Jan. 8, 2008

(51) Int. Cl.
*A44B 11/00* (2006.01)

(52) U.S. Cl. ..... 224/163; 224/930; 24/163 K

(58) Field of Classification Search ..... 224/163, 224/930; 24/163 K; 40/640
See application file for complete search history.

(56) References Cited

U.S. PATENT DOCUMENTS

| | | | | |
|---|---|---|---|---|
| 1,723,742 | A * | 8/1929 | Marcus | 224/163 |
| 4,432,477 | A | 2/1984 | Haidt et al. | |
| 4,534,063 | A * | 8/1985 | Krumin et al. | 455/344 |
| 4,536,094 | A * | 8/1985 | Nagura | 368/278 |
| 4,670,945 | A * | 6/1987 | Banks | 24/170 |
| 4,770,328 | A * | 9/1988 | Dickhudt et al. | 224/666 |
| 4,905,878 | A | 3/1990 | Lovinger et al. | |
| 5,102,023 | A * | 4/1992 | Nguyen | 224/163 |
| 5,106,004 | A * | 4/1992 | Nguyen | 224/163 |
| 5,410,762 | A | 5/1995 | Maskovich | |
| 6,137,675 | A | 10/2000 | Perkins | |
| 6,311,881 | B1 | 11/2001 | Kamiya | |
| 6,328,193 | B1 | 12/2001 | Schiff | |
| 6,359,609 | B1 * | 3/2002 | Kuenster et al. | 345/156 |
| 6,549,789 | B1 * | 4/2003 | Kfoury | 455/550.1 |
| 6,769,587 | B1 | 8/2004 | Lomas | |
| 6,832,712 | B2 | 12/2004 | Turner | |
| 6,886,724 | B2 * | 5/2005 | Hung | 224/163 |
| 7,099,149 | B2 * | 8/2006 | Krieger et al. | 361/679.3 |
| 7,665,641 | B2 * | 2/2010 | Kaufman | 224/261 |
| 2004/0155084 | A1 | 8/2004 | Brown | |
| 2004/0256432 | A1 | 12/2004 | Orenstein | |
| 2006/0138301 | A1 | 6/2006 | Kaufman | |
| 2006/0186150 | A1 | 8/2006 | Willows et al. | |
| 2007/0215663 | A1 | 9/2007 | Chongson et al. | |
| 2010/0008514 | A1 * | 1/2010 | Bates et al. | 381/77 |

OTHER PUBLICATIONS

Tune Buckle™/Let Go. Free Your Soul.™ web page www.tunebuckle.com. Effective date unknown.

* cited by examiner

*Primary Examiner* — Justin Larson
(74) *Attorney, Agent, or Firm* — Carter & Schnedler, P.A.

(57) ABSTRACT

Apparatus for securing a compact portable device which includes a viewing screen to a wearer. A base is attachable to a belt and configured to serve as a belt buckle. A panel has a decorative side and a device side, and an attachment for securing the compact portable device to the device side of the panel, with the viewing screen exposed. A swivel joint connects the panel to the base in a manner such that the panel can selectively be oriented, with reference to the base, with the panel and the base generally parallel and the decorative side of the panel visible, with the panel and the base generally parallel and the viewing screen visible, or with the panel extending outwardly and turned for viewing the viewing screen.

6 Claims, 6 Drawing Sheets

BELT BUCKLE WITH COMPARTMENT FOR PORTABLE DEVICE

BACKGROUND OF THE INVENTION

The invention relates generally to compact portable devices which include viewing screens, and more particularly, to an apparatus for securing such a compact portable device to a wearer.

SUMMARY OF THE INVENTION

In one aspect, apparatus for securing a compact portable device including a viewing screen to a wearer is provided. The apparatus includes a base attachable to a belt and configured to serve as a belt buckle, a panel having a decorative side and a device side, and an attachment for securing the compact portable device to the device side of the panel, with the viewing screen exposed. A swivel joint connects the panel to the base in a manner such that the panel can selectively be oriented, with reference to the base, with the panel and the base generally parallel and the decorative side of the panel visible, or with the panel extending outwardly and turned for viewing the viewing screen.

In another aspect, apparatus for securing a compact portable device including a viewing screen to a wearer is provided. The apparatus includes a base attachable to a belt and configured to serve as a belt buckle, a panel having a decorative side and a device side, and an attachment for securing the compact portable device to the device side of the panel, with the viewing screen exposed. A swivel joint connects the panel to the base in a manner such that the panel can selectively be oriented, with reference to the base, with the panel and the base generally parallel and the viewing screen visible, or with the panel extending outwardly and turned for viewing the viewing screen.

DETAILED DESCRIPTION

Figure 1:
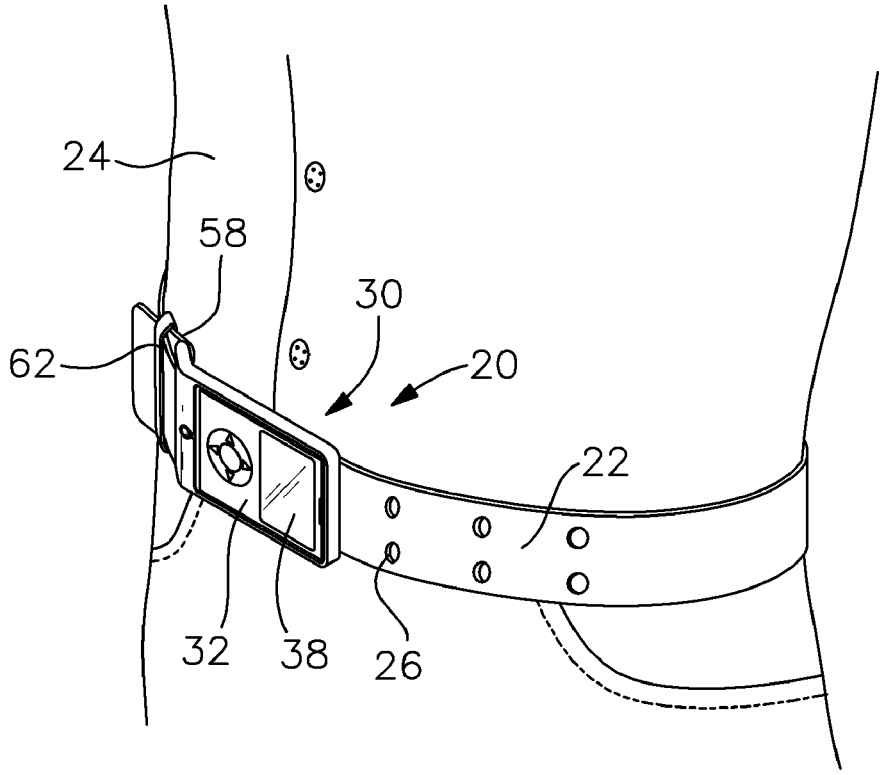
FIG. 1 is a three dimensional view of apparatus embodying the invention worn by a wearer.

With reference to FIG. 1, apparatus 20 embodying the invention serves as a belt buckle, to secure a belt 22 worn by a wearer 24. The particular belt 22 is made of leather and has a series of grommeted apertures 26 which are engaged by tangs 28 (FIGS. 3, 4 and 6) of a belt buckle 30 which also serves as a base 30.

Figure 2:
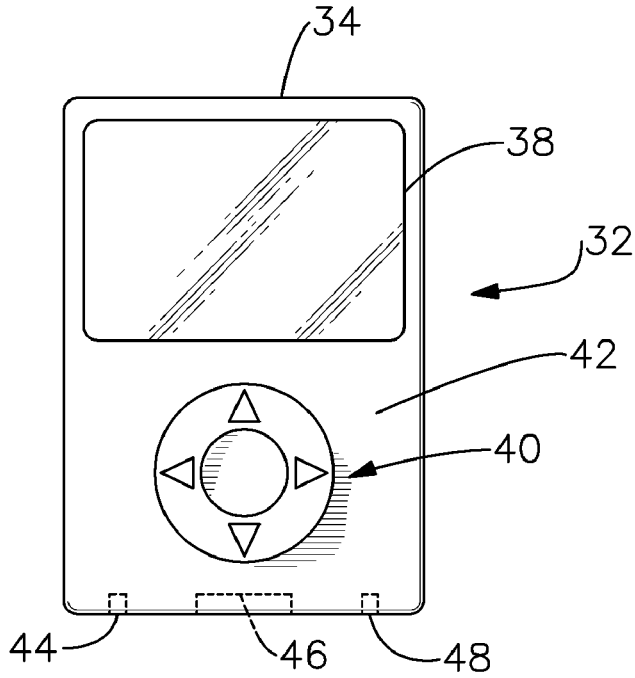
FIG. 2 is a front view of a representative compact portable device including a viewing screen, in isolation, in the representative form of an iPod nano, made by Apple Computer Corporation.

FIG. 2, by way of example, illustrates a representative compact portable device 32, in the form of an Apple "iPod nano." As is known, an "iPod nano" also serves as a portable music player, in addition to its function as a video display device. The device 32 has a top 34 and a bottom 36, and includes a viewing screen 38, as well as a touch pad control 40 on its front surface 42. Accessible along the bottom 36 are an ON/OFF switch 44, a slightly recessed multi-function connector 46, and an earpiece jack 48. The compact portable device 32 is representative of any one of a number of devices which include viewing screens, such as a personal digital assistant (PDA), cellular telephone, a video game device, or a satellite radio receiver as examples.

With reference to FIGS. 3-6, the apparatus 20 includes the base 30 which is configured to serve as the belt buckle 30. For strength, the base 30 or belt buckle 30 is made of metal.

Figure 3:
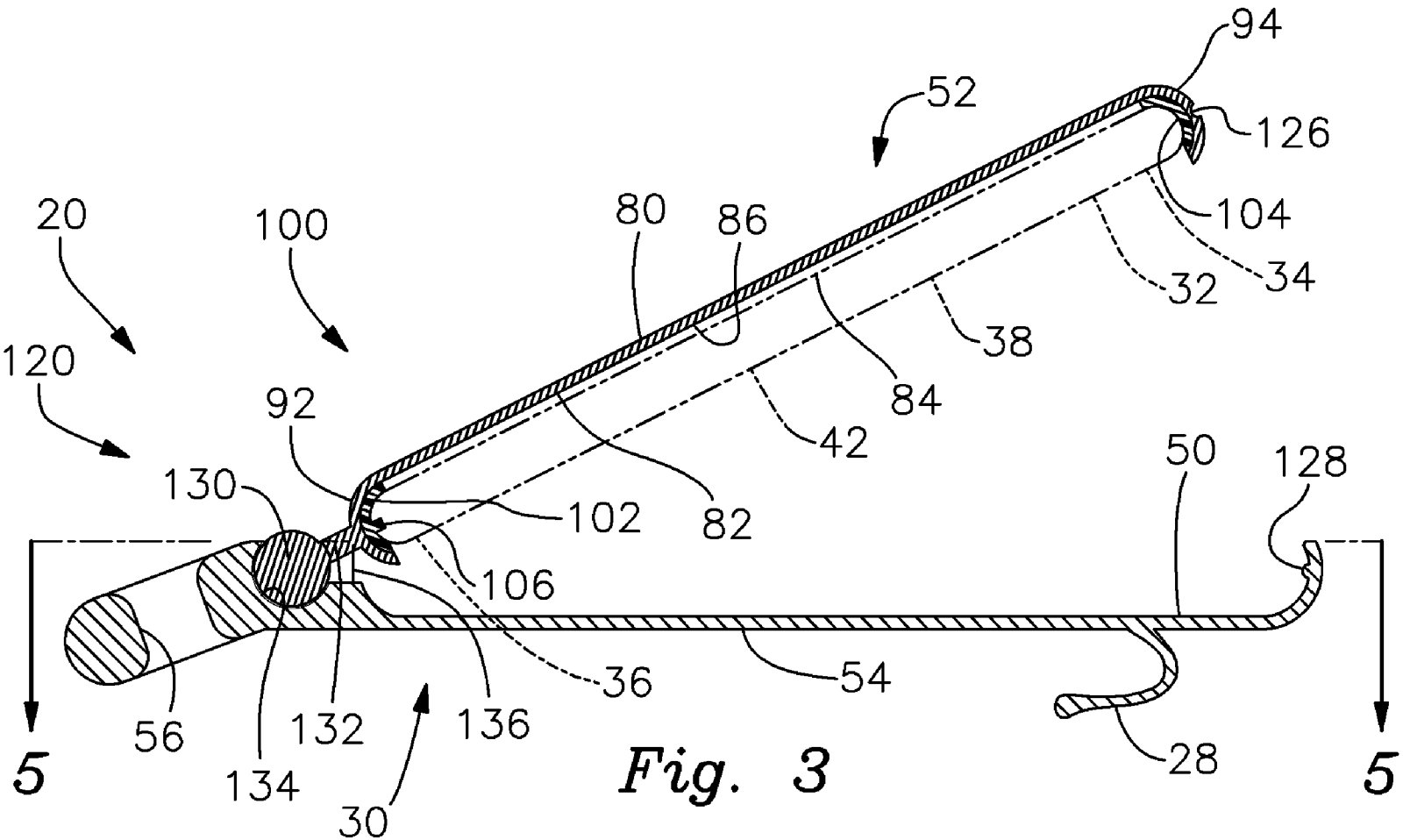
FIG. 3 is a cross-sectional side elevational view of apparatus embodying the invention with the panel partly open, and holding the representative compact portable device of FIG. 2 (shown in phantom)
Figure 4:
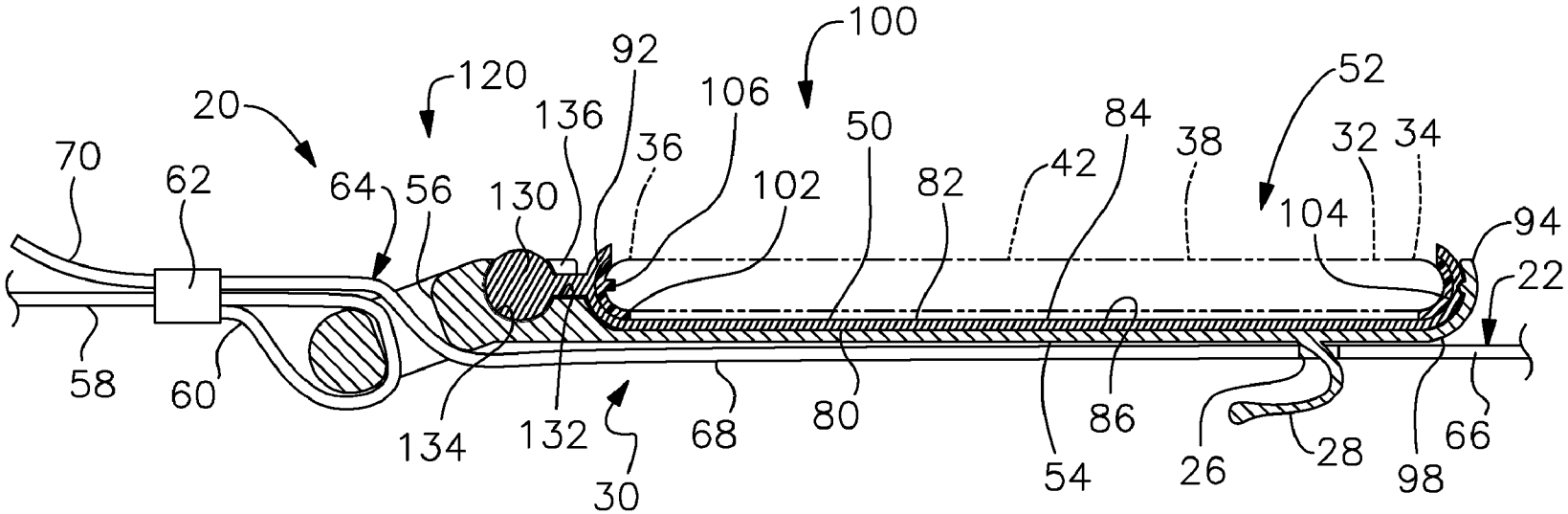
FIG. 4 is a cross-sectional side elevational view similar to FIG. 3, but with the panel in a different position ("closed facing out position"), and also showing attachment to a belt.
Figure 5:
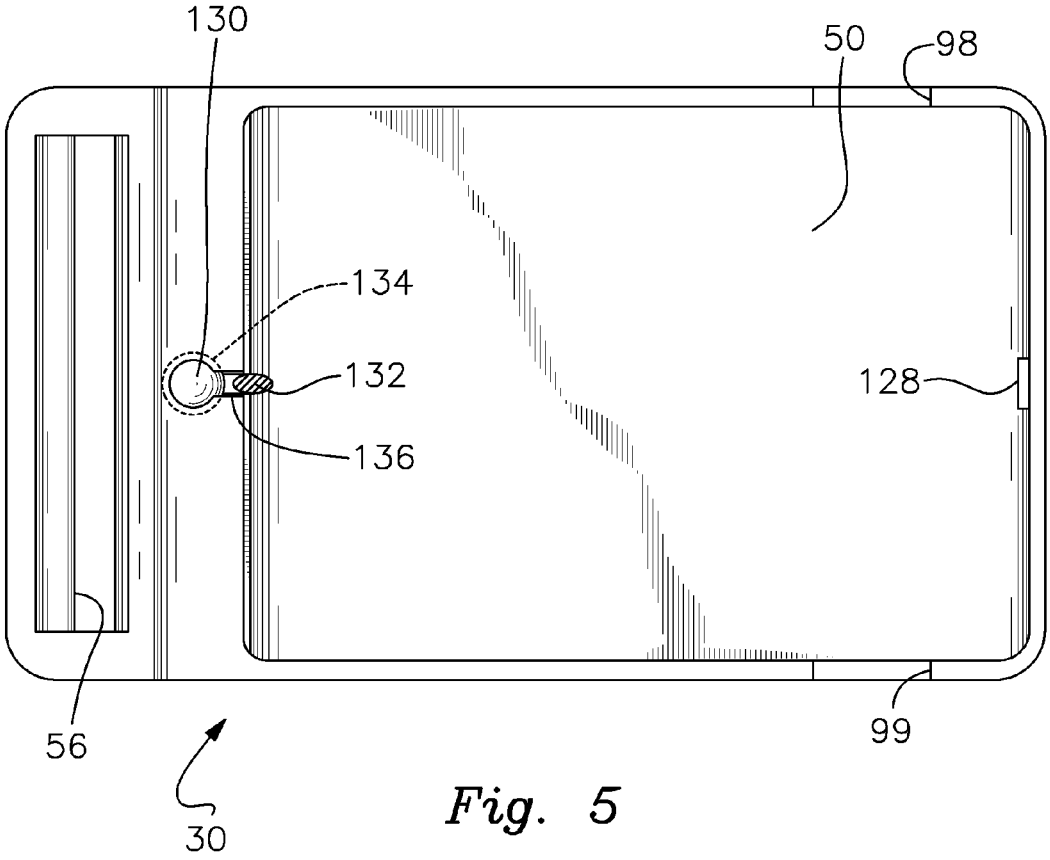
FIG. 5 is a view taken on line 5-5 of FIG. 3, and is generally a plan view of the buckle/base part of the apparatus.
Figure 6:
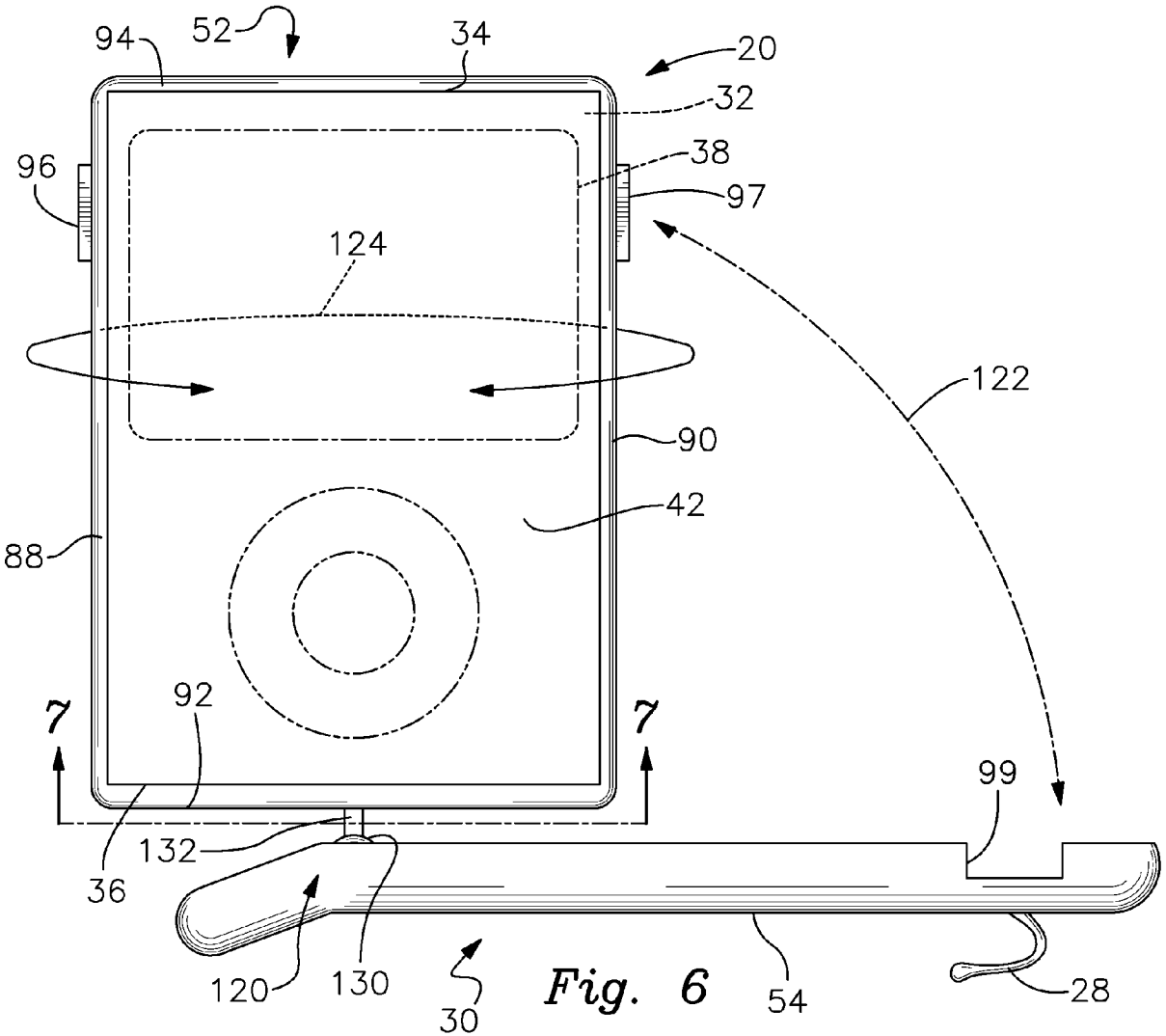
FIG. 6 depicts the apparatus in use, with the panel swiveled out such that the viewing screen of the compact portable device is visible, the compact portable device being shown in phantom.

Referring in particular to the cross-sectional side view of FIG. 3, as well as to FIG. 5, which is in effect a plan view of the base 30, the base 30 generally takes the form of a flat rectangular object including a top side recess 50 which receives a moveable panel 52 (FIGS. 3, 4 and 6). The tangs 28 for engaging the grommeted apertures 26 on the belt 22 are attached to the underside 54 of the base 30, opposite the recess 50, and may be integral therewith. As part of its belt buckle function, the base 30 additionally includes a slotted aperture 56 through which the belt 22 passes. More particularly, and with reference to FIG. 4, one end 58 of the belt 22 is looped through the aperture 56 and sewn to itself at 60 so as to be secured to the base 30 in the manner of a conventional belt buckle. The belt 22 also includes a retention loop 62 near the end 58.

After encircling the waist of the wearer 24, the other end of the webbed belt 22, generally designated 64, approaches the belt buckle/base 30 at 66, is retained by the tangs 28 engaging selected ones of the grommeted apertures 26 in a conventional manner, passes further along the underside 54 of the belt buckle/base 30 at 68, then up through the slotted aperture 56, and through the retention loop 62 to emerge at 70. The distal end is not visible in FIG. 4.

With reference to FIGS. 3, 4, 6 and 7, the moveable panel 52 has a decorative side 80 and a device side 82. The device side 82 of the panel 52 includes a device-receiving recess 84 or compartment 84, within which the compact portable device 32 is at least partially received and attached. The recess 84 more particularly is defined by a recess bottom 86, recess side walls 88 and 90, a recess lower end wall 92 which corresponds to the bottom 36 of the representative device 32, and a recess upper end wall 94 which corresponds to the top 34 of the device 32. A pair of pull tabs 96 and 97 project laterally outwardly from the side walls 88 and 90 to aid in withdrawing the moveable panel 52 from the recess 50 in the base 30. Corresponding relief cutouts 98 and 99 are provided in the sides of the recess 50 in the base 30. The pull tabs 96 and 97 are sized such that, when the moveable panel 52 is received in the recess 50, the pull tabs 96 and 97 project through the relief cutouts slightly beyond the extent of the base 30.

An attachment for the device 32 is generally designated 100, and takes the representative form of resilient liners 102 and 104, such as rubber liners 102 and 104, fitted within the lower 92 and upper 94 ends of the recess 84. The rubber liners 102 and 104 snuggly hold the compact portable device 32 within the recess 84. In addition, to further aid retention of the device 32, the rubber liner 102 at the recess lower end 92 wall has a rectangular protrusion 106 which engages the recess for the multi-function connector 46 of the representative compact portable device 32.

Figure 7:
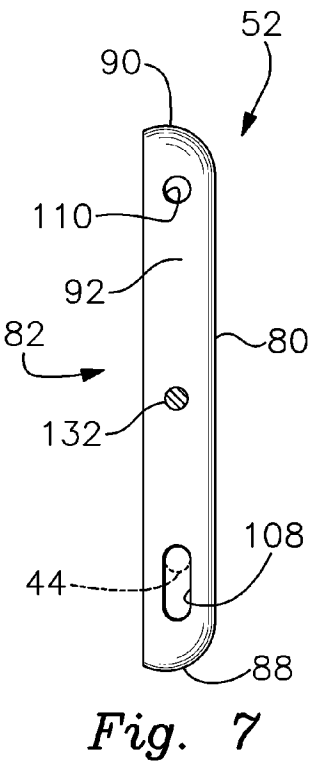
FIG. 7 is an end view taken on line 7-7 of FIG. 6, showing access apertures for connectors of the compact portable device.

Related to that, and with reference to FIG. 7, apertures 108 and 110 are provided through the lower end wall 92 of the recess 84 (as well as through the rubber liner 102) to allow access to the ON/OFF switch 44 and earpiece jack 48 of the compact portable device 32.

When secured within the recess 84, the front surface 42 and viewing screen 38 of the device 32 are exposed, at least with the moveable panel 52 is partially or fully open as in FIGS. 3 and 6, or in a "closed facing out" position as in FIGS. 1 and 4. Various positions of the moveable panel 52 and thus of the device 32 and viewing screen 38 are described in further detail hereinbelow.

A swivel joint, generally designated 120, provides a hinge connection between the moveable panel 52 and the belt buckle/base 30. Significantly, the swivel joint 120 connects the moveable panel 52 to the belt buckle/base 30 in a manner such that the panel 52, and thus the device 32 with its viewing screen 38, can selectively be oriented with reference to the base 30 in various positions or orientations. The swivel joint 120 allows 360° rotation. Thus, as described hereinabove, FIGS. 1 and 4 illustrate the "closed facing out position" in which the moveable panel 52 is received in the top side recess 50 such that the panel 52 and base 30 are generally parallel with the decorative side 80 facing the top side recess 50 and the viewing screen 38 is visible. There also is a "closed facing in position" (not specifically illustrated), which results when the moveable panel 52 in the orientation of FIG. 3 is pivoted down all the way into the recess 50. In the "closed facing in position," the moveable panel 52 is received in the recess 50 such that the panel 52 and base 30 are generally parallel with the device side 82 facing the top side recess 50, and the decorative side 80 of the panel 52 is visible.

As shown in the in-use position of FIG. 6, the swivel joint 120 allows the panel 52 to extend outwardly from the base, by way of example and not limitation, at an angle of 90°, as indicated by arrow 122, and also turned or rotated for viewing the viewing screen 38, as indicated by arrow 124. As a result, the wearer 24, when standing, can look down and see the viewing screen 38 of the device 32. Alternatively, the wearer 24 can be reclining, and likewise be able to easily see the viewing screen 38 when the moveable panel 52 is oriented as in FIG. 6.

To secure the moveable panel 52 when received in the recess 50 in the base 30, an indentation 126 is formed on the outside of the upper end wall 94 of the moveable panel 52 opposite the swivel joint 120. A corresponding inwardly-extending protrusion 128 is provided at the end of the recess 50 in the base 30, configured so as to "snap" into the indentation 126.

In the illustrated embodiment, the swivel joint 120 takes the representative form of a ball and socket. Integral with the moveable panel 52 and projecting from the lower end wall 92 is a ball 130 supported on a short neck 132. A corresponding socket 134 is provided in the base 30, intermediate the recess 50 and the slotted aperture 56. To provide clearance for the neck 132 when the moveable panel 52 is in either of its "closed" positions in which the panel 52 is received in the recess 50 and generally parallel to the base 30, a relief passage 136 is provided extending between the socket 134 and recess 50 in the base 30.

Although a particular form of swivel joint 120 is illustrated, it will be appreciated that a variety of mechanical structures may be provided, such as structures resembling hinge pins, and/or shafts within cylindrical apertures. Since there are no electrical connections such as wires between the moveable panel 52 and the base 30, there are few constraints on the design of the swivel joint 120. Thus, for example, in the extended position of FIG. 6, it is not necessary to limit the rotation represented by arrow 124.

Figure 8:
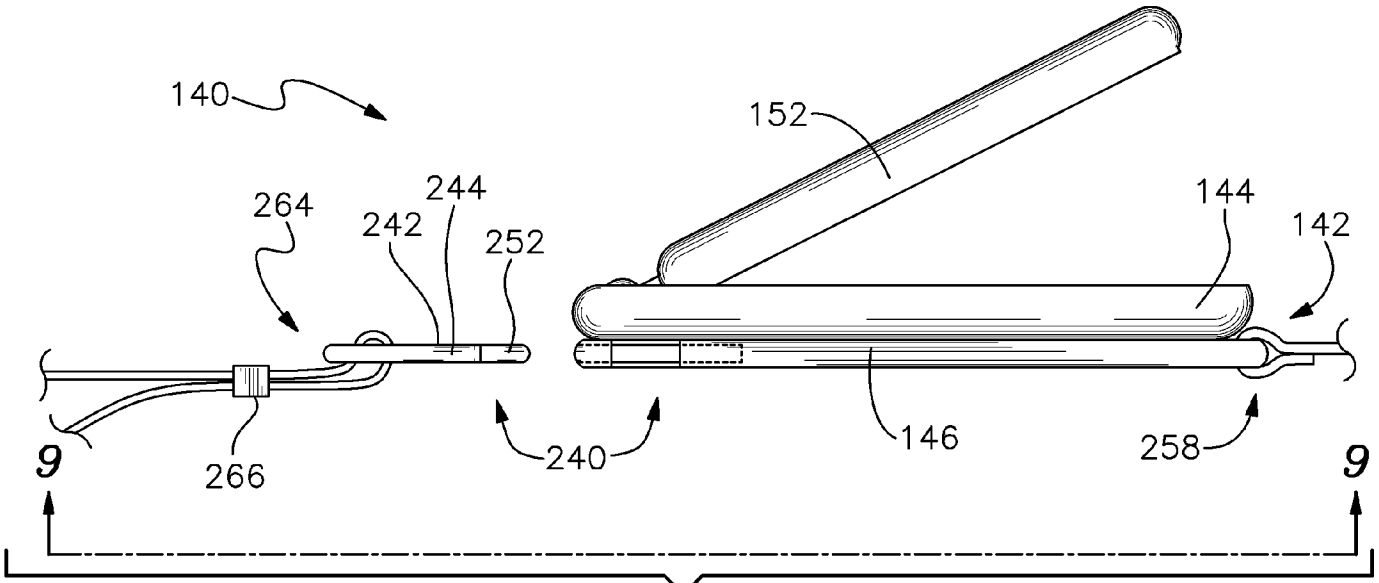
FIG. 8 is a side elevational view of an alternative embodiment of the invention.
Figure 9:
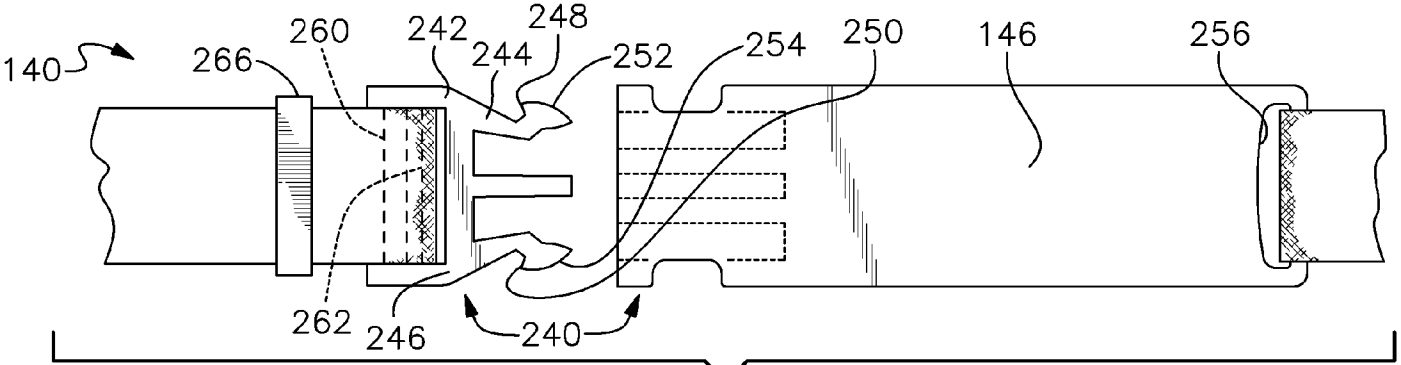
FIG. 9 is an underside view taken on line 9-9 of FIG. 8.

Referring finally to FIGS. 8 and 9, illustrated is another form of apparatus 140 embodying the invention. The apparatus 140 of FIGS. 8 and 9 differs from the apparatus 20 of FIGS. 1-7 in that a base 142 which also serves as a belt buckle includes, as separate portions, a holder base portion 144 and a buckle element portion 146. The holder base portion 144 specifically generally corresponds to the base 30 of the apparatus 20, but lacks the tangs 28. The holder base portion 144 and the buckle element 146 may either be integral and manufactured as a single piece, or manufactured as separate pieces and attached to each other employing adhesive (not shown) or fasteners (not shown).

Other than lacking the tangs 28, the holder base portion 144 is essentially identical to the base 30 of the apparatus 20 as described hereinabove with reference to FIGS. 1-7, and accordingly is not further described here. Likewise, the apparatus 140 of FIGS. 8 and 9 includes a moveable panel 152 which is identical to the moveable panel 52 of the apparatus 20 of FIGS. 1-7, as well as a swivel joint 220 which is identical to the swivel joint 120 of the apparatus 20.

The buckle element portion 146 more particularly is part of a generally conventional side release snap buckle 240, which includes another element 242. The other element 242 has resilient side snaps 244 and 246 with respective latching surfaces 248 and 250, and push-to-release surfaces 252 and 254.

Buckle element 146 has a slotted aperture 256 for attaching one end 258 (FIG. 8) of a belt. The other buckle element 242 has a pair of slotted apertures 260 and 262 for attaching the other end 264 (FIG. 8) of the belt. The attachment of the end 264 includes a length adjustment, represented by element 266.

Although the embodiment 140 of FIGS. 8 and 9 includes a side-release snap buckle 240, it will be appreciated that the invention may be embodied in apparatus including bases configured to serve as belt buckles of a variety of types.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Apparatus for securing a compact portable device including a viewing screen to a wearer, said apparatus comprising:

a base attachable to a belt and configured to serve as a belt buckle, said base having a top side and an underside;

a panel having a decorative side and a device side;

an attachment for securing the compact portable device to said device side of said panel, with the viewing screen exposed; and a swivel joint in the form of a ball and socket connecting said panel to said base in a manner such that said panel can selectively be oriented, with reference to said base, with said panel and said base generally parallel with said device side of said panel facing said top side of said base and said decorative side of said panel visible, or with said panel extending outwardly and turned for viewing the viewing screen.

2. The apparatus of claim 1, wherein said swivel joint connects said panel to said base in a manner such that said panel can selectively further be oriented, with reference to said base, with said panel and said base generally parallel with said decorative side of said panel facing said top side of said base and the viewing screen visible.

3. The apparatus of claim 1, wherein said device side of said panel has a device-receiving recess within which the device is at least partially received.

4. The apparatus of claim 2, wherein said device side of said panel has a device-receiving recess within which the device is at least partially received.

5. Apparatus for securing a compact portable device including a viewing screen to a wearer, said apparatus comprising:

a base attachable to a belt and configured to serve as a belt buckle;

a panel having a decorative side and a device side;

an attachment for securing the compact portable device to said device side of said panel, with the viewing screen exposed; and a swivel joint in the form of a ball and socket connecting said panel to said base in a manner such that said panel can selectively be oriented, with reference to said base, with said panel and said base generally parallel with said decorative side of said panel facing said top side of said base and the viewing screen visible, or with said panel extending outwardly and turned for viewing the viewing screen.

6. The apparatus of claim 5, wherein said device side of said panel has a device-receiving recess within which the device is at least partially received.

* * * * *